US005209586A

United States Patent [19]

Furrow et al.

[11] Patent Number: 5,209,586

[45] Date of Patent: May 11, 1993

[54] RIBBON CARTRIDGE AND PRINTER DRIVE SYSTEM FOR THE RIBBON

[75] Inventors: Edward D. Furrow; Gerald S. Cox, both of Waynesboro, Va.

[73] Assignee: Genicom Corporation, Waynesboro, Va.

[21] Appl. No.: 926,645

[22] Filed: Aug. 10, 1992

[51] Int. Cl.[5] ..... B41J 32/00

[52] U.S. Cl. ..... 400/196.1; 400/208; 400/248

[58] Field of Search ..... 400/196, 196.1, 208, 400/208.1, 201, 247, 248

[56] References Cited

U.S. PATENT DOCUMENTS

| | | | |
|---|---|---|---|
| 3,814,231 | 6/1974 | Cappotto | 400/248 |
| 3,863,749 | 2/1975 | Perry et al. | 400/196.1 |
| 4,088,218 | 5/1978 | Depew | 400/196.1 |
| 4,153,378 | 5/1979 | Scherrer et al. | 400/196.1 |
| 4,243,334 | 1/1981 | Shigemori | 400/247 |
| 4,293,234 | 10/1981 | Yonkers et al. | 400/196.1 |
| 4,383,774 | 5/1983 | Yonkers | 400/195 |
| 4,623,274 | 11/1986 | Ohsaki | 400/196.1 |
| 4,817,844 | 4/1989 | Chenest | 400/196.1 |
| 4,852,439 | 4/1986 | LaSpesa | 400/196.1 |
| 4,900,170 | 2/1990 | Beck et al. | 400/196.1 |
| 5,007,750 | 4/1991 | Goubeaux | 400/196.1 |

FOREIGN PATENT DOCUMENTS

| | | | |
|---|---|---|---|
| 0240112 | 10/1987 | European Pat. Off. | 400/196.1 |
| 0132581 | 8/1983 | Japan | 400/201 |
| 0124278 | 7/1985 | Japan | 400/201 |
| 0055181 | 3/1987 | Japan | 400/248 |

OTHER PUBLICATIONS

"Stuffed Take-up With Seperator" IBM Technical Disclosure Bulletin, vol. 23, No. 11, Apr. 1981, p. 5004.

"Ribbon Cartridge Drive" IBM Technical Disclosure Bulletin, vol. 20, No. 5, Oct. 1977, p. 1735.

*Primary Examiner*—Eugene H. Eickholt

*Attorney, Agent, or Firm*—Nixon & Vanderhye

[57] ABSTRACT

The ribbon cartridge includes a storage chamber for the print ribbon, openings through its top and bottom walls adjacent the storage chamber, and a stripper for maintaining the ribbon in the storage chamber likewise adjacent the openings. A ribbon drive mechanism is mounted on the printer deck and includes a drive gear, and an idler gear mounted on a pivoted lever, also pivotally carrying a cam. The lever is pivotable between positions opening and closing the rollers. A stripper actuating member is movable in response to rotation of the cam and displaces the stripper, when the cartridge is disposed on the printer, toward and away from the drive mechanism. The cam also enables opening and closing movement of the rollers to disengage and engage the ribbon, respectively.

27 Claims, 9 Drawing Sheets

FIG. 5
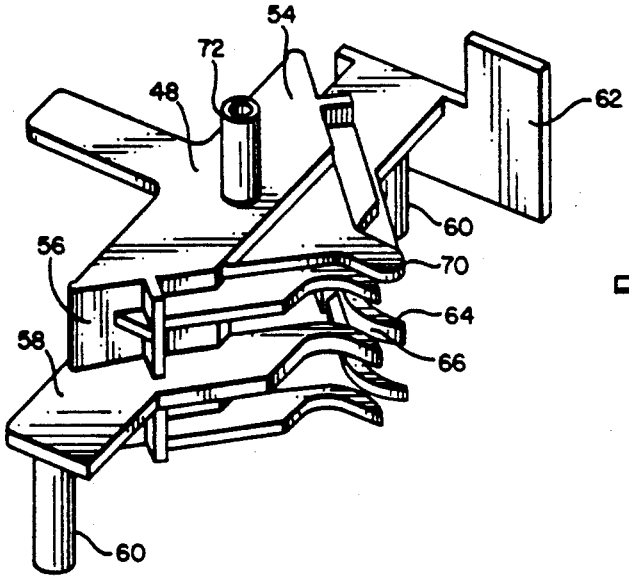
FIG. 8
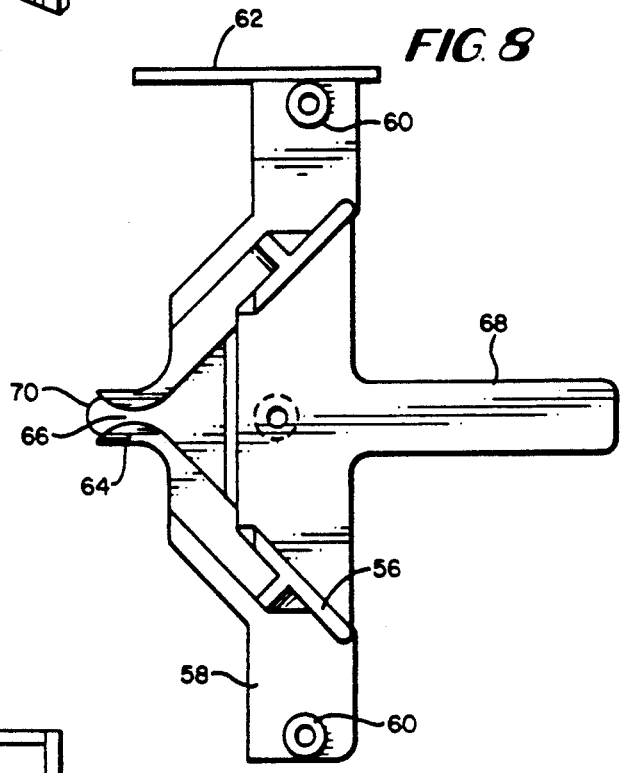
FIG. 6
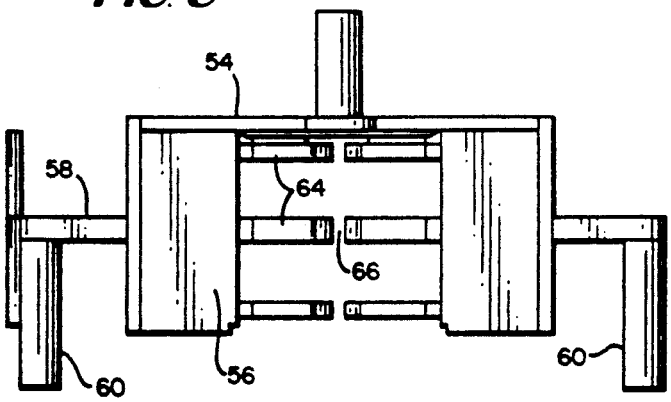
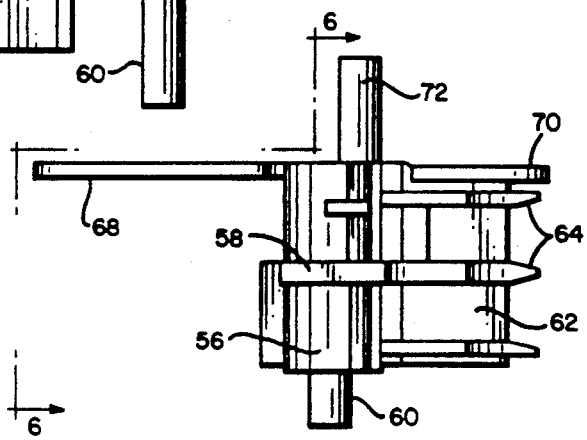
FIG. 7

FIG. 17
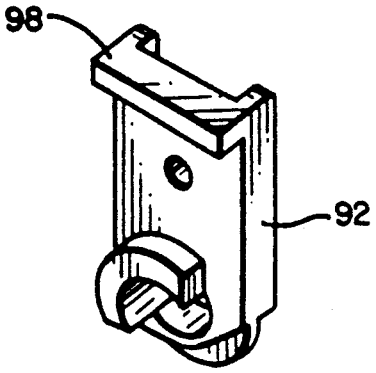
FIG. 18
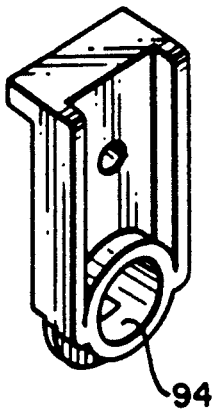
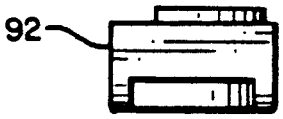
FIG. 19
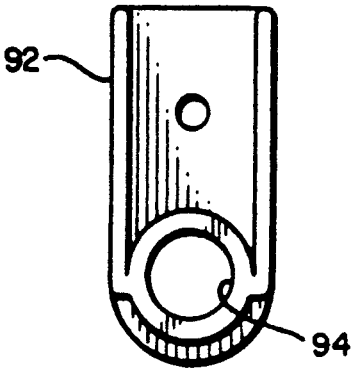
FIG. 20
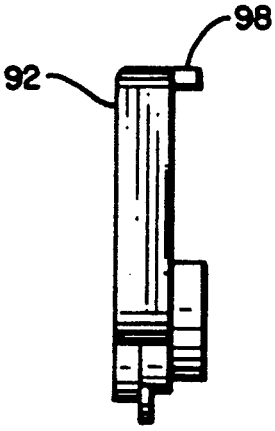
FIG. 21

RIBBON CARTRIDGE AND PRINTER DRIVE SYSTEM FOR THE RIBBON

BACKGROUND AND SUMMARY OF THE INVENTION

The present invention relates to ribbon cartridges containing an endless print ribbon for use in printers and drive systems for the ribbon cartridges forming part of the printer. Particularly, the invention relates to a ribbon cartridge having component parts for transporting, guiding and storing the endless print ribbon and which parts are cooperable with a drive system mounted on the printer for driving the print ribbon, whereby the number of parts and, hence, the cost of the consumable ribbon cartridges are reduced.

In most commercial high-speed printers, ribbon cartridges are consumable items discarded with use and replaced with fresh cartridges. Even in those ribbon cartridges containing a re-inker and which cartridges therefore have extended useful life, ultimately the cartridge is discarded and replaced. Such ribbon cartridges typically mount the ribbon drive system within the cartridge and which drive system is therefore discarded with the ribbon cartridge. These ribbon drive systems substantially increase the cost of the ribbon cartridge. Consequently, otherwise reusable drive system components are discarded and replaced with new cartridges likewise containing duplicate and otherwise reusable drive system components.

In certain printing systems these disadvantages have been obviated to some extent by locating the drive rollers forming an integral part of the drive system in the printer. In this manner, the print ribbon cartridges do not carry the drive rollers and the same drive rollers of the printer are used to drive the ribbons of the replacement cartridges. A system of this type is disclosed in U.S. Pat. No. 4,293,234, issued Oct. 6, 1981. Such system apparently, however, has not resulted in any widespread use and presumably this is a result of a number of factors, including complexity of the system and its cost.

According to the present invention, there is provided a novel and improved ribbon cartridge and drive system therefor which locates the drive system for the print ribbon of the cartridge in the printer eliminating any necessity for the cartridge to carry and mount drive system components as integral parts thereof whereby substantial reductions in the cost of the consumable cartridges by elimination of the drive system components therefrom are achieved. To accomplish this, the present invention provides a replaceable ribbon cartridge in the form of an elongated, generally rectilinear housing having ribbon entrance and exit arms projecting to one side of the housing at its opposite ends, respectively. The housing includes top, bottom and side walls which in part define a ribbon storage chamber which extends over a substantial majority of the length of the housing. The endless ribbon thus extends from the ribbon storage chamber, preferably through a mobius loop, and along the exit arm, passes out of the exit arm for spanning between the tips of the exit and entrance arms, and reenters the cartridge through the entrance arm for return to the storage chamber. The bottom wall of the cartridge has an opening which, when the cartridge is applied in overlying relation to the printer deck, receives the ribbon drive system which is mounted on the printer deck. The print ribbon of the cartridge spans across the opening in the bottom wall of the cartridge and the drive system, as described hereinafter, has a mechanism for engaging and disengaging the print ribbon enabling the cartridge to be placed on the printer for use and removed therefrom for replacement. The cartridge therefore serves to transport, guide and store the ribbon but does not contain a drive system for the ribbon.

The cartridge, however, contains a stripper which performs the twofold function of providing a wall at one end of the ribbon storage chamber for maintaining the ribbon in a folded, preferably random folded, condition, as well as providing stripper elements for stripping the ribbon from the rollers forming part of the printer-mounted drive system for the ribbon when the cartridge is loaded into the printer for use. The stripper is mounted for generally linear movement within the cartridge housing between a retracted position and a position locating the stripper elements adjacent the nip of the drive system rollers to strip the ribbon from the rollers and feed it into the storage chamber. The cartridge is therefore specifically formed to transport, guide and store the ribbon and to cooperate with a drive system forming part of the printer which serves to engage and drive the ribbon when the cartridge is loaded into the printer and to release the ribbon when the cartridge is removed from the printer for replacement.

The ribbon cartridge hereof may or may not include a re-inker, depending upon the needs of the user of the cartridge and associated printer. Additionally, the cartridge is provided with a spooler for taking up slack in the ribbon spanning between the ends of the exit and entrance arms, thereby ensuring that the ribbon extending across the print mechanism, upon loading the cartridge into the printer, is straight and taut. It also simultaneously takes up slack in the ribbon spanning across the bottom opening in the cartridge to ensure, when the cartridge is loaded into the printer, that the ribbon will be engaged with the drive system. The spooler includes two parallel bars or pins carried by a manually rotatable device. By threading the ribbon between the bars or pins and rotating the device, the ribbon rapidly rolls up on the bars, tightening the ribbon spanning between the tips of the entrance and exit arms and across the cartridge opening. The freely rotatable spooler also enables the ribbon to be unwrapped therefrom when the drive system is engaged and printing commences.

It will be appreciated that the component parts of the ribbon cartridge described above may be provided in kit form for subsequent assembly. Thus, the housing may be provided in the form of discrete top and bottom wall parts, with the side walls being carried by one or the other of those parts or, alternatively, portions of the side walls may form parts of the top and bottom wall parts, respectively. The ribbon entrance and exit arms also form portions of the top and bottom wall component parts. The top and bottom walls are configured to define the storage chamber for the ribbon upon assembly thereof and the bottom wall part has an opening for receiving the roller drive mechanism upon assembly of the cartridge and loading it into the printer. The top and bottom wall parts may be assembled and secured one to the other to form the ribbon cartridge by staking, ultrasonic welding of the plastic material or otherwise, as desired.

As part of the kit, there is provided a stripper which includes a pair of laterally spaced stripper elements defining a slot therebetween for receiving the ribbon when the assembled cartridge is loaded onto the printer. The stripper also has a pair of depending pins which are receivable through openings, preferably elongated slots, in the bottom wall part such that, when the stripper is assembled into the cartridge, the pins project through the slots for engagement by a drive mechanism whereby the stripper may be moved longitudinally within and along the cartridge upon assembly. Guide surfaces are provided on the stripper to facilitate this movement. Various other parts may be formed as integral or attachable elements to the top and bottom wall parts. For example, pins for mounting guide rollers for the ribbon may project from one or the other of the top or bottom wall parts. The spooler may be provided as a separable part for alignment with openings in both the top and bottom wall parts upon assembly such that the spooler can be manually rotated.

In accordance with the present invention, the drive system is mounted on the printer deck and includes a control means for controllably displacing an idler roller toward and away from a drive roller between positions engaging the ribbon between the rollers and disengaging it from the rollers. The control means also linearly displaces a stripper actuating member engageable with the stripper in the cartridge upon loading the cartridge into the printer to move the stripper between its retracted and stripping positions. To accomplish the foregoing, the drive system includes a base secured to the printer deck and mounting a drive roller connected to a drive motor within the printer. A lever is movably mounted on the base, preferably pivotally mounted, and carries an idler roller for movement toward and away from the drive roller. A spring biases the lever for movement in a direction tending to engage the idler roller against the drive roller. The lever also pivotally carries an underlying cam. The cam is rotatable by a crank arm and is cooperable with a pin mounted on the base for displacing the lever against the bias of the spring in a direction moving the idler roller away from the drive roller. The cam carries a detent surface which cooperates with the pin for detenting the lever in a retracted position spacing the idler roller from the drive roller to enable placement of the print ribbon between the spaced rollers when the cartridge is loaded into the printer. By rotating the crank arm and moving the detent surface of the pin, the spring bias moves the lever into an engaged position, enabling the ribbon to be gripped between the idler and drive rollers.

Additionally, a stripper actuating member is slidably mounted on the printer deck and a stripper actuating member drive arm interconnects the cam and the stripper actuating arm. In a preferred form of the present invention, the actuating member has recesses for receiving pins which project downwardly from the stripper through elongated slots in the bottom wall of the cartridge such that the actuating member and stripper are engaged one with the other when the cartridge is loaded into the printer. The drive arm is connected to the cam such that, when the lever is in its retracted position spacing the idler roller from the drive roller, the actuating member is spaced and retracted from the rollers. It will be appreciated that this retracted position of the actuating member corresponds to the retracted position of the stripper in the cartridge.

To load the cartridge into the printer, and assuming the lever is detented to space the idler roller from the drive roller, the cartridge is placed on the printer deck with the drive system of the printer being received into the confines of the cartridge housing through the opening in the bottom wall, the crank handle also being received through an opening through the top wall of the cartridge. The print ribbon is thus disposed between the spaced idler and drive rollers. The stripper and stripper actuating member are also engaged one with the other and lie in their retracted positions. The crank arm is then rotated to release the detenting cam and pin, enabling the spring to rotate the lever to engage the ribbon between the idler and drive rollers. Simultaneously, rotation of the crank arm also rotates the cam to pull the drive arm and, hence, the actuating member in a direction toward the rollers. This, in turn, moves the stripper in the cartridge toward its operable position engaging the stripper elements in grooves on the idler and drive rollers. When engaged and the printer is operated, these stripper elements serve to strip the ribbon from the rollers and guide the ribbon into the storage chamber. The engagement of the stripper elements within grooves in the rollers also locks the cartridge against displacement from the printer deck. Additionally, the crank arm, when rotated to engage the ribbon between the rollers, is rotated into a position overlying the top wall of the cartridge housing and this also precludes removal of the cartridge from the printer deck.

To replace the cartridge after use, the crank arm is rotated so that the cam bears against the pin and rotates the lever against the spring bias to retract the idler roller from engagement with the ribbon and the drive roller. Simultaneously, the cam pushes the drive arm to move the actuating member away from the rollers and, consequently, the stripper in the cartridge is likewise moved away from the rollers. This withdraws the stripper elements from within the grooves of the idler and drive rollers, and aligns the crank arm with the openings through the top and bottom walls of the cartridge housing, enabling the cartridge to be moved from the printer deck.

In a preferred embodiment according to the present invention, there is provided a ribbon cartridge for a printer having a ribbon drive mechanism including a pair of rollers for engaging a print ribbon therebetween, comprising an elongated cartridge housing having top, bottom, and side walls and a pair of arms projecting to one side of the housing adjacent to opposite ends, the walls in part defining a storage chamber for receiving and storing the print ribbon, and the arms defining entrance and exit paths, respectively, for receiving the ribbon for delivery to the storage chamber and supplying the ribbon from the storage chamber for spanning between the arms. The bottom wall has an opening for receiving the pair of rollers substantially within the confines of the cartridge housing when the cartridge is loaded into the printer. A stripper having stripper elements is carried by the cartridge housing for movement between a first retracted position and a second extended position with the stripper elements disposed adjacent the pair of rollers for stripping the ribbon from the rollers. The bottom wall of the housing includes a pair of openings having an extent in the direction of the housing substantially at least equal to the range of movement of the stripper in the cartridge between the first and second positions. The stripper includes a pair of pins projecting through the openings below the bottom wall for engagement of at least one pin thereof by a drive carried by the printer for displacing the stripper from one of the first and second positions into the other of the first and second positions.

In a further preferred embodiment according to the present invention, there is provided a printer having a printer deck for mounting a printer cartridge containing print ribbon, a drive mechanism for the print ribbon, comprising drive and idler rollers carried by the printer and projecting from the printer deck. A lever carries the idler roller and is mounted for movement on the printer deck for moving the idler roller laterally toward and away from the drive roller. Means for moving the lever between a first position for engaging the print ribbon between the rollers and a second position spacing the idler roller from the drive roller, together with means for biasing the lever for movement into one of the first and second positions are provided. Means for detenting the lever in the other of said first and second positions, as well as control means for displacing the lever from the detented position enabling the lever for movement toward the one position are also provided. A ribbon stripper actuating member engages the ribbon stripper in the cartridge and is carried by the printer deck for movement toward and away from the rollers. An arm interconnects the member and the moving means such that the member is movable toward and away from the rollers in response to movement of the idler gear toward and away from the drive roller, respectively.

In a further preferred embodiment of the present invention, there is provided a parts kit for assembly into a ribbon cartridge for a printer having a ribbon drive mechanism, including a pair of rollers for engaging a ribbon therebetween, comprising a top wall part having portions for defining in part a storage chamber for a ribbon and a bottom wall part having portions for defining in part the storage chamber for the ribbon, the bottom wall part having an opening for receiving the ribbon drive mechanism upon loading the assembled cartridge into the printer. One of the top and bottom wall parts includes portions defining at least in part ribbon entrance and ribbon exit arms, the top and bottom wall parts being adapted for assembly one with the other to form the ribbon cartridge with the portions of the top and bottom wall parts defining a storage chamber for the ribbon. A stripper is provided for assembly within the cartridge, the stripper including a pair of laterally spaced stripper elements for stripping ribbon from the rollers and defining a slot therebetween for receiving ribbon upon assembly of the kit to form the cartridge and loading thereof into the printer, the stripper having guides for mounting the stripper within the cartridge upon its assembly for movement in a direction toward and away from the bottom opening and having at least one pin projecting therefrom and through the bottom wall part for engagement by the drive mechanism upon loading the assembled cartridge into the printer.

In a further preferred embodiment according to the present invention, there is provided a stripper for location in a ribbon cartridge for stripping ribbon from drive rollers and guiding the ribbon into a storage chamber of the cartridge, comprising a stripper body for generally horizontal slidable movement within the cartridge toward and away from the drive rollers and having a laterally extending wall and a pair of laterally spaced stripper elements projecting forwardly from the stripper body and defining a forwardly extending slot for receiving ribbon therebetween. Upstanding wall portions project from the laterally extending wall and are located rearwardly of the stripper elements for engaging ribbon in the storage chamber of the cartridge on the side of the stripper body opposite the stripper elements, the wall portions having an opening therebetween for receiving ribbon from the slot for entry into the storage chamber. A pair of pins project downwardly from the laterally extending wall adjacent its opposite ends and for termination below the stripper elements.

Accordingly, it is a primary object of the present invention to provide a novel and improved reduced cost print ribbon cartridge having a minimum of parts and functions, a kit of parts therefor and a drive system for the print ribbon carried by the printer for releasable engagement with the ribbon carried by the cartridge.

These and further objects and advantages of the present invention will become more apparent upon reference to the following specification, appended claims and drawings.

BRIEF DESCRIPTION OF THE DRAWING FIGURES

FIG. 5 is a perspective view of a stripper carried by the cartridge;

FIG. 6 is a rear elevational view of the stripper as viewed from the storage chamber side of the cartridge and taken generally about on line 6—6 in FIG. 7;

FIG. 7 is a side elevational view of the stripper;

FIG. 8 is a bottom plan view of the stripper;

FIGS. 17 and 18 are perspective views from opposite sides of a bearing end cap for mounting the drive roller;

FIG. 19 is a top plan view of the bearing cap;

FIGS. 20 and 21 are top, plan and left side elevational views of the bearing end cap;

DETAILED DESCRIPTION OF THE DRAWING FIGURES

Reference will now be made in detail to a present preferred embodiment of the invention, an example of which is illustrated in the accompanying drawings.

Figure 1:
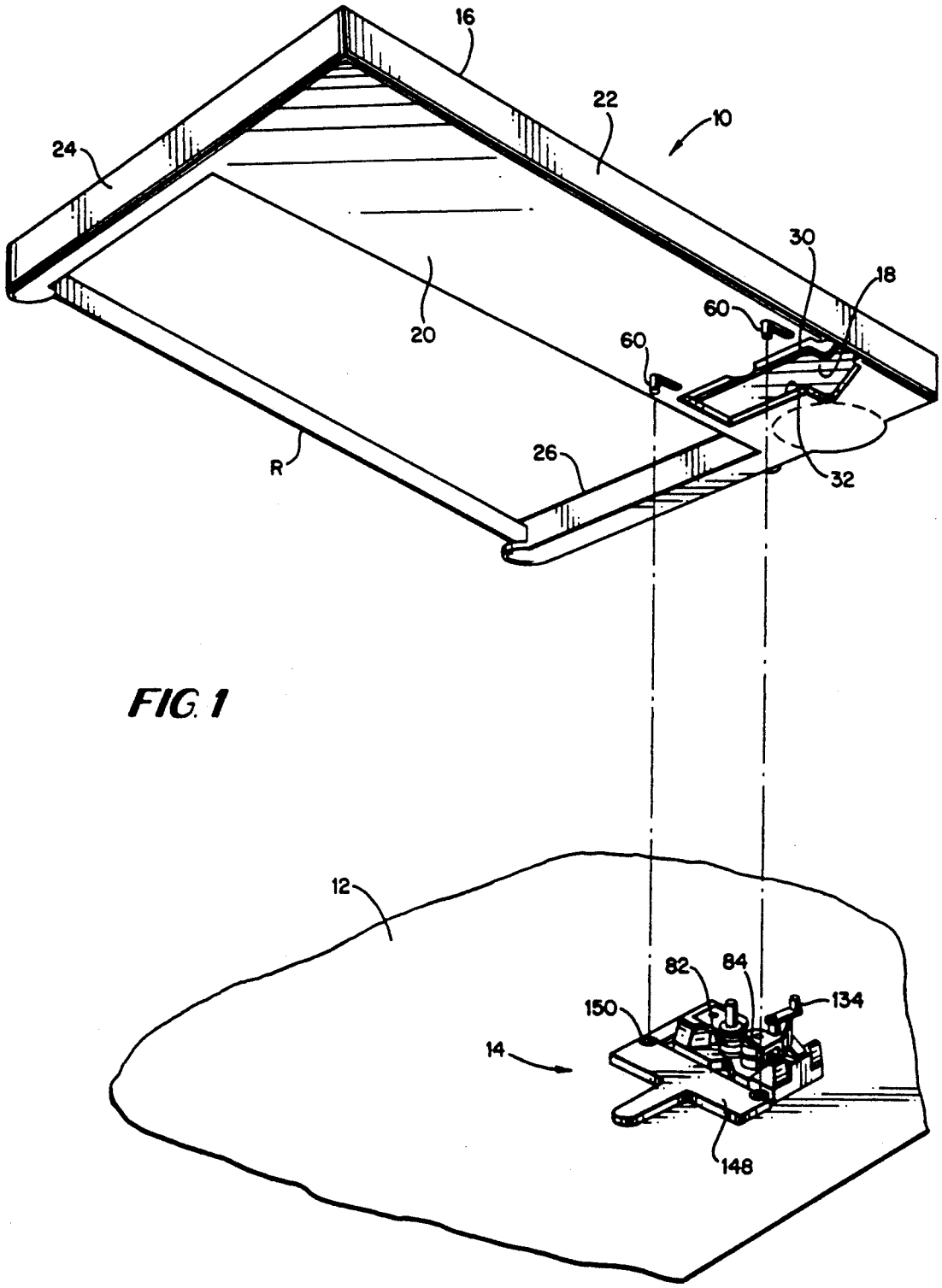
FIG. 1 is a bottom perspective view of a print ribbon cartridge in overlying relation to a drive system mounted on a printer deck shown in a top perspective view, all in accordance with the present invention.
Figure 3:
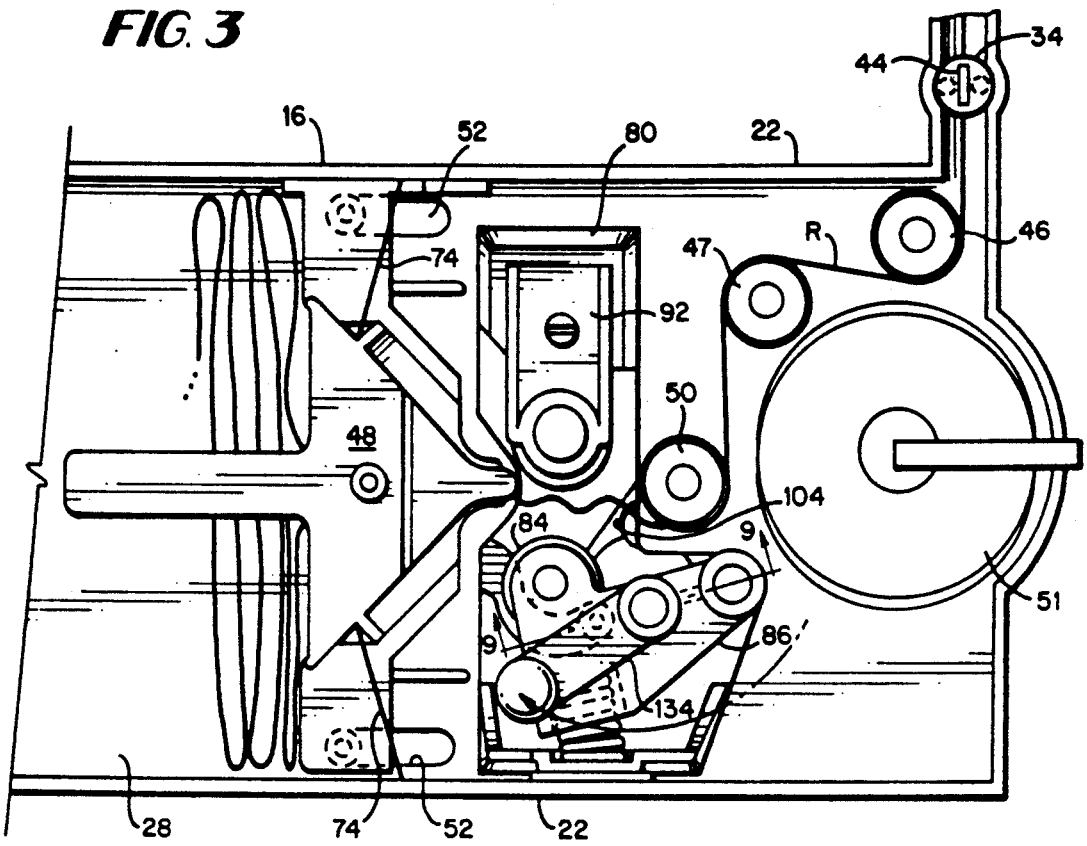
FIGS. 3 and 4 are fragmentary views of the cartridge with its top wall removed and applied to the drive system on the printer deck, illustrating in FIG. 3 the drive system in its non-engaged position and, in FIG. 4, the operable engagement of the drive system with the ribbon in the cartridge.
Figure 4:
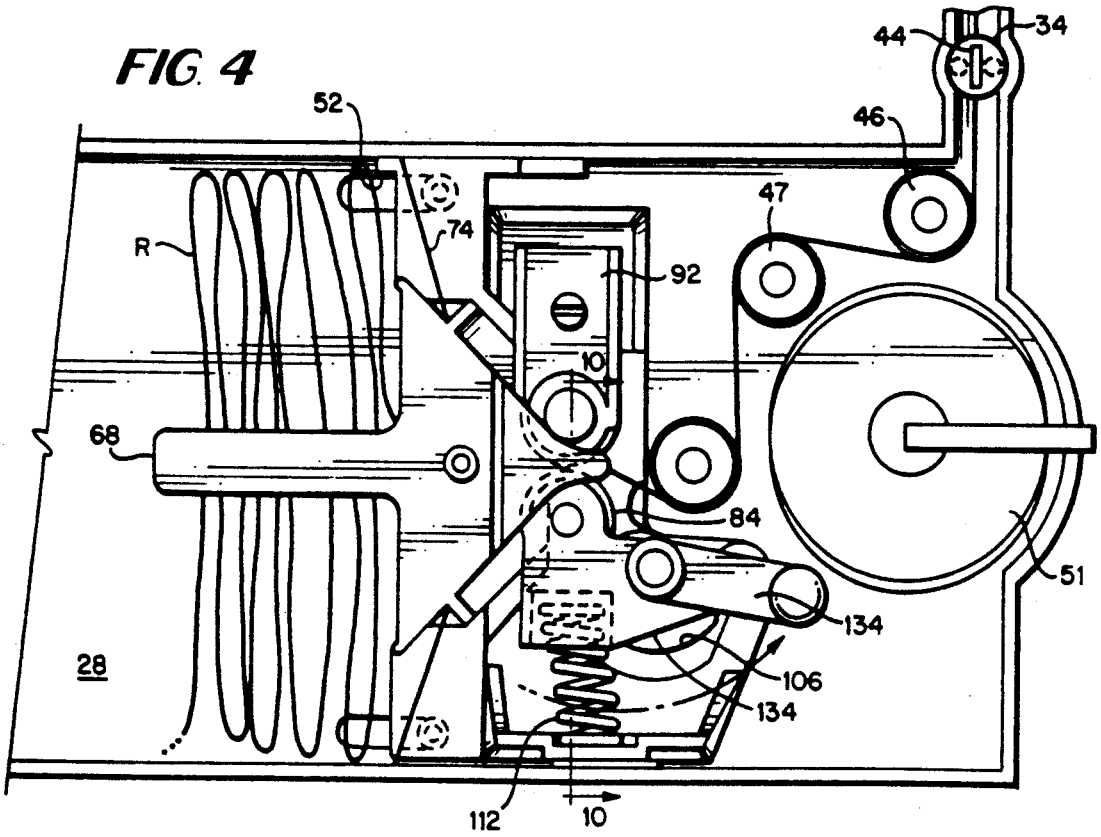

Referring now to the drawings, particularly to FIG. 1, there is illustrated a cartridge, generally designated 10, constructed in accordance with the present invention, for mounting on the printer deck 12 of a printer, and overlying relation to a drive mechanism, generally designated 14, also constructed in accordance with the present invention. As illustrated, ribbon cartridge 10 comprises a generally rectilinear housing 16 having top and bottom walls 18 and 20, respectively, and side walls 22. Housing 16 also includes ribbon exit and entrance arms 24 and 26, respectively. It will be appreciated that a ribbon R spans between the distal ends of the ribbon exit and entrance arms 24 and 26, respectively, and comprises an endless ribbon driven by drive mechanism 14 when cartridge 10 is loaded into the printer. Housing 16 as illustrated in FIGS. 3 and 4 includes a storage chamber 28 for storing the endless ribbon R, preferably in a random fashion, and which storage chamber 28 extends the majority of the length of housing 16. Adjacent the end of storage chamber 28 and exit arm 24, there is provided an inverting mechanism, i e., a mobius loop, not shown, for inverting the ribbon drawn from storage chamber 28. It will be appreciated that drive mechanism 14 removes (pulls) ribbon R from storage chamber 28, inverts the ribbon, passes it into exit arm 24, and pulls the ribbon from the exit arm 24 to span tightly between arms 24 and 26 along a print line of the printer and then for entry into entry arm 26 and storage at the opposite end of storage chamber 28.

Figure 27:
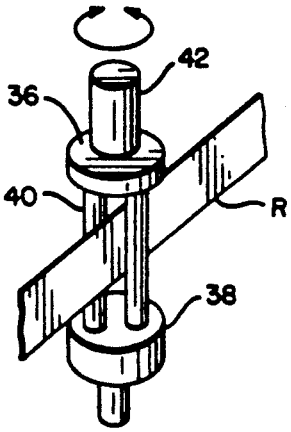
FIG. 27 is a fragmentary perspective view of a spooling device used in the entrance arm of the cartridge for spooling the ribbon.

As illustrated in FIG. 1, upper wall 18 of housing 16 has an opening 30, and lower wall 20 has an opening 32 in registration with the upper wall opening 30. The openings are provided to receive drive mechanism 14 when the cartridge 10 is loaded into the printer such that drive mechanism 14 lies within the confines of cartridge 10. In entrance arm 26, there is provided a rotary device 34 for spooling the ribbon R, prior to mounting the cartridge in the printer, to draw the ribbon taut between the distal ends of the exit and entrance arms 24 and 26 and also across the bottom opening 32. The spooling device is best illustrated in FIG. 27 and includes a pair of disks 36 and 38 connected one to the other by spaced pins or bars 40. Stub shafts 42 are provided on the opposite ends of the rotary device 34 and the ribbon R is threaded between the bars 40. It will be appreciated that by mounting the rotary device 34 in the entrance arm 26 and providing a tab 44 accessible through the top or bottom wall, manual rotation of the rotary device causes the ribbon R to spool onto the bars 40. Thus, the ribbon can be simultaneously drawn taut between the distal ends of the exit and entry arms 24 and 26, respectively, and between the rotary device 34 and the storage chamber 28 across bottom opening 32. Also, the ribbon can be readily unwound from the freely rotatable device 34 when the ribbon drive system is actuated.

Referring now to FIGS. 3 and 4, ribbon R extends from the rotary device 34 about a plurality of rollers 46, 47 and 50 and spans between the upper and lower openings 30 and 32, respectively, in the top and bottom walls of the cartridge housing 16. The ribbon extends through a stripper 48 which, in conjunction with the drive system, disposes the ribbon into the storage chamber 28. Also in FIGS. 3 and 4, there is illustrated a re-inking device 51 which may or may not be used in the cartridge, depending upon the user's needs. It will be appreciated that re-inkers per se are old in the art and that the ribbon R would be rerouted otherwise than as shown to engage the re-inker.

As illustrated in FIGS. 1–4, the bottom wall 20 of housing 16 is provided with a pair of slots 52 adjacent respective opposite side walls 22 for slidably mounting the stripper 48. Stripper 48 extends transversely between side walls 22 and includes, as illustrated best in FIGS. 5–8, an upper wall 54, laterally spaced, angularly related depending side walls 56, and a pair of laterally extending horizontal intermediate walls 58 carrying downwardly projecting pins 60 adjacent opposite sides of stripper 48, with one side of the stripper 48 having an additional side wall 62. A plurality of paired stripper elements 64 are vertically spaced one from the other and define a feed slot 66 for feeding ribbon R from drive mechanism 14 into storage chamber 28. Upper wall 54 includes a rearwardly projecting tongue 68 and a forwardly projecting tab 70 for overlying the edge of the ribbon as the ribbon proceeds through the rollers of the drive mechanism and into slot 66. A pin 72 projects upwardly from wall 54 and is received through a slot, not shown, in the upper wall of the cartridge.

Referring to FIGS. 3 and 4, stripper 48 is slidably disposed in cartridge housing 16 with pins 60 engaging through slots 52 in bottom wall 20. Consequently, stripper 48 is linearly movable between positions retracted from the bottom opening 32 and, hence, the drive mechanism 14, when received through bottom opening 32, and extended in a ribbon engaged position adjacent the rollers of the drive system, to be described. The stripper 48 is maintained in its retracted position by a pair of flat leaf springs 74 (FIGS. 3 and 4) engaging between abutments on side walls 22 and side walls 56 of stripper 48. When the stripper 48 moves from the retracted position illustrated in FIG. 3 to its advanced position in FIG. 4, springs 74 flex in the opposite direction biasing the stripper into its extended engaged position illustrated in FIG. 4. Hence, stripper 48 is detented in both positions.

As will be recalled, the various elements of the cartridge as described above may be provided in a kit of parts. For example, the top wall, bottom wall, configured as described, the stripper, the various rollers, and spooler may be provided as separate discrete parts by a manufacturer for later assembly into the cartridge with the ribbon in the storage chamber. Staking, welding, adhesive or other forms of securement may be used to maintain the parts in their assembled condition.

Figure 2:
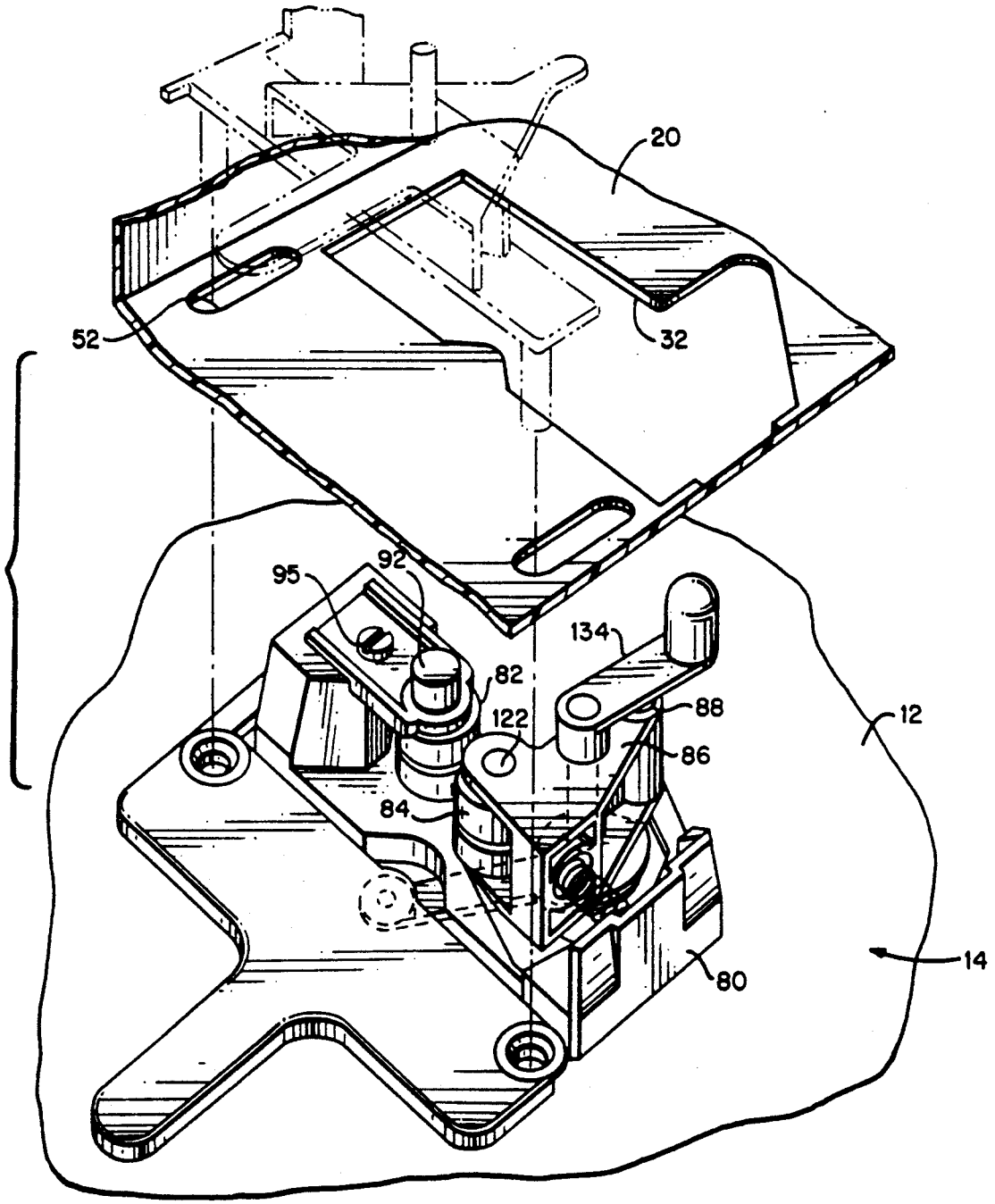
FIG. 2 is a fragmentary perspective view of the bottom wall of the cartridge and the drive mechanism on the printer deck illustrating the manner in which the ribbon cartridge is loaded into the printer.

Referring now to FIG. 2, drive system 14 will now be described. In FIG. 2, drive system 14 is illustrated mounted on printer deck 12 and includes a frame or base 80 mounting a drive roller 82 fixed for rotation by a drive motor, not shown, within the printer. In lateral opposition to drive roller 82 is an idler roller 84 mounted on a lever 86 movable, preferably pivotable, about the axis of a pin 88 between positions wherein idler roller 84 is retracted and spaced from the drive roller, as illustrated in FIG. 3, and in engagement with the ribbon R disposed between the drive roller and idler roller, as illustrated in FIG. 4. For ease of explanation, the various parts of the drive mechanism, as illustrated in FIGS. 13–25, will be described.

The base frame 80 is secured to printer deck 12 and includes a lower bearing 90 (FIG. 13) for mounting the drive pin 92 carrying drive roller 82. With reference to FIGS. 2, 13 and 17–21, a bearing cap 92 having a bearing 94 is secured by screw 95 on a mount 96 of base 80, with the lip 98 being received in a slot 100. Thus, the drive pin 92 is carried by bearings 90 and 94.

Figure 10:
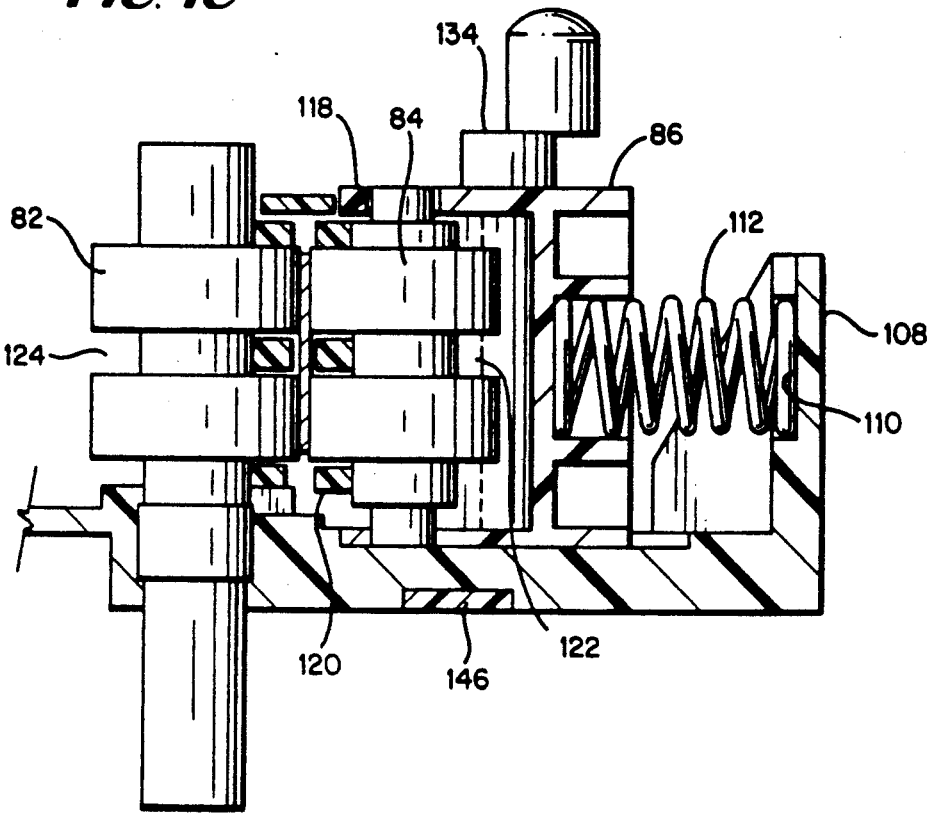
FIG. 10 is an enlarged cross-sectional view of the drive system engaged with the print ribbon and taken generally about on line 10—10 in FIG. 4.
Figure 9:
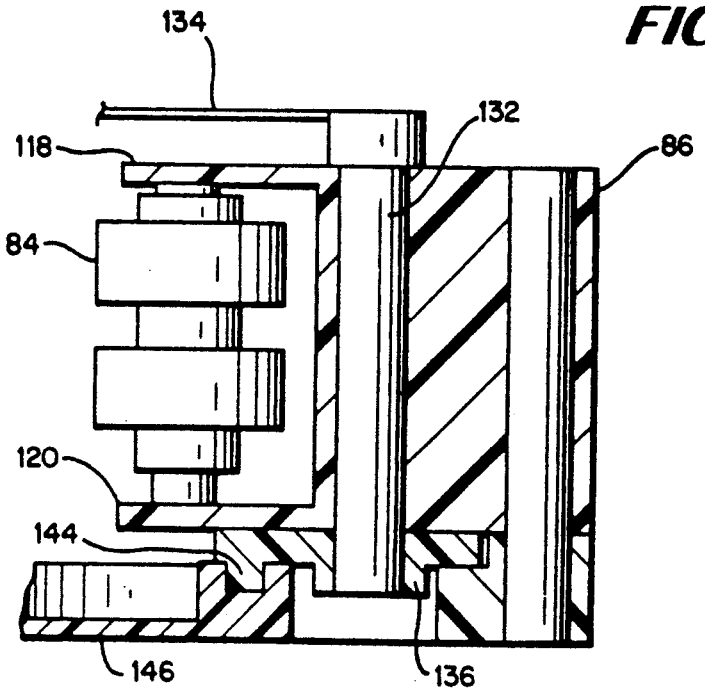
FIG. 9 is an enlarged cross-sectional view of a portion of the drive system taken generally about on line 9—9 in FIG. 3.
Figure 13:
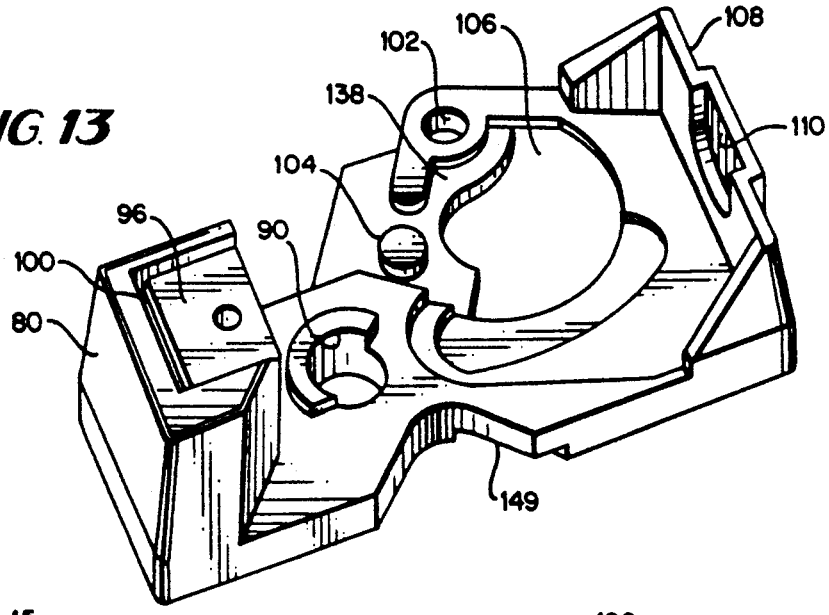
FIG. 13 is a perspective view of the base of the drive system for mounting on the printer deck.
Figure 14:
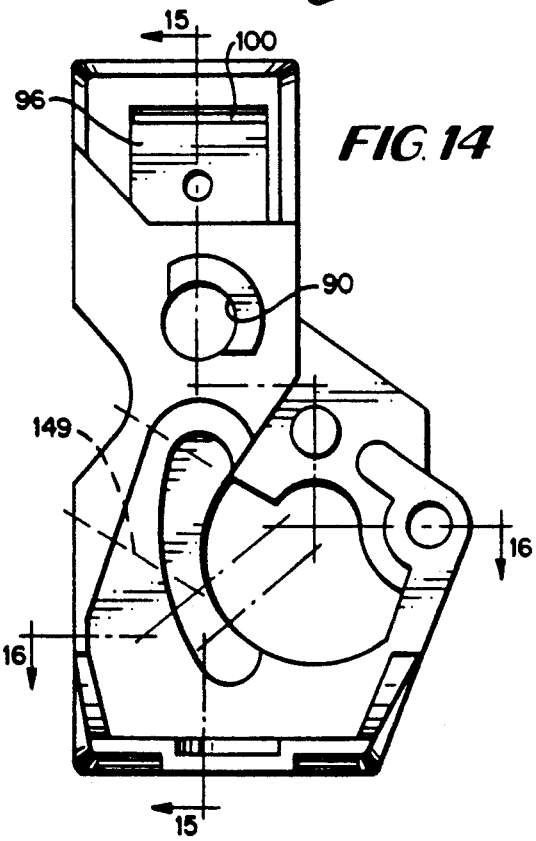
FIG. 14 is a plan view thereof.
Figure 15:
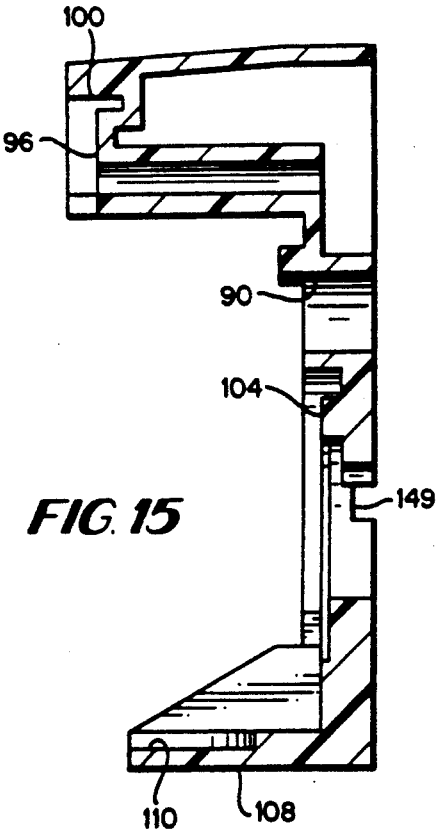
FIG. 15 is a cross-sectional view thereof taken generally about on line 15—15 in FIG. 14.
Figure 16:
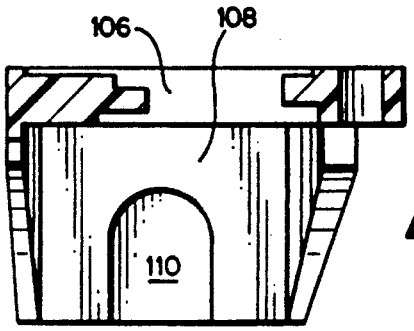
FIG. 16 is a cross-sectional view thereof taken generally about on line 16—16 in FIG. 14.
Figure 22:
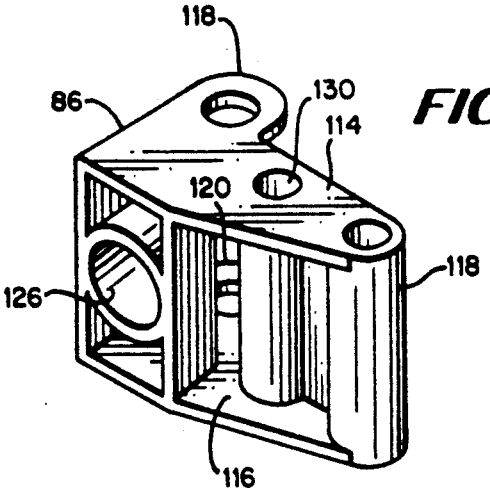
FIG. 22 is a perspective view of the lever for mounting the idler roller.
Figure 23:
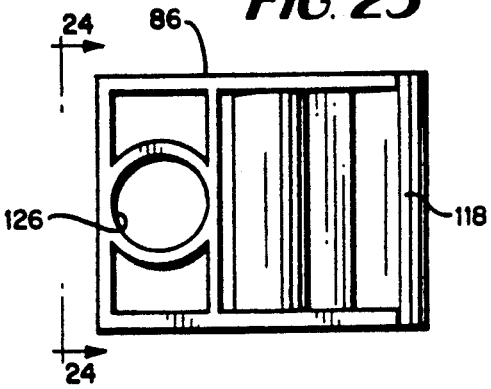
FIG. 23 is an elevational view of the rear face of the lever.
Figure 24:
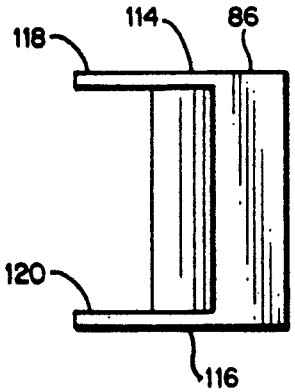
FIG. 24 is an elevational view thereof taken generally about on line 24—24 in FIG. 23.
Figure 26:
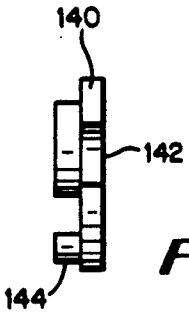
FIG. 26 is a side elevational view of the cam illustrated in FIG. 25.
Figure 25:
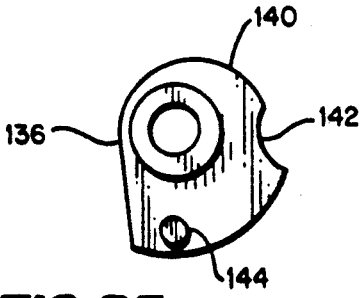
FIG. 25 is a bottom plan view of the cam mounted on the underside of the lever.

In FIG. 13, there is illustrated a bearing 102 for the pin 88 carrying lever 86. Adjacent bearing 82 is an upstanding pin 104 for cooperation with a cam 136, described hereinafter. Base 80 also includes an opening 106 between its upper and lower sides and has an upstanding end wall 108 with a recess 110 for mounting one end of a helical coil spring 112. Referring to FIGS. 22–24, lever 86 includes upper and lower lever arms 114 and 116 connected together by a sleeve 118 at one end of the lever for receiving pin 88 whereby the lever is mounted for pivotal movement. The opposite ends of the lever arms 114 and 116 mount aligned projecting ears 118 and 120, respectively, which, in turn, mount the pin 122 carrying idler roller 84. For reasons discussed hereinafter and as best illustrated in FIG. 10, both the idler roller 84 and drive roller 82 are centrally recessed to provide annular grooves 122 and 124, respectively. As illustrated in FIGS. 22 and 23, lever 86 is provided with an opening 126 on a side thereof opposite ears 118 and 120 for receiving the other end of coil spring 112. Thus, from a review of FIG. 2, when the lever 86 is mounted for pivotal movement on bearing 102 (FIG. 13), spring 112 biases lever 86 toward the engaged position of the ribbon between the two rollers. Lever 86 also carries a bore 130 spaced from its axis of rotation about bearing 102. A pin 132 is disposed in bore 130 and mounts a crank handle 134 at its upper end for rotating the pin 132. The lower end of pin 132 carries a cam 136 illustrated in FIGS. 25 and 26. Cam 136 is rotatable with lever 86 about bearing 102 and is itself rotatable about the axis of bore 130 by rotation of crank arm 134. Cam 136 is disposed in the opening 106 and bears on a stepped portion 138 of base 80. Cam 136 includes a cam surface 140 eccentric to its axis of rotation and which cam surface 140 includes a detenting surface 142 for engagement with pin 104 (FIG. 13). Also projecting from the underside of cam 136 is a drive pin 144 connecting with a drive arm 146 (FIG. 11) for displacing a stripper actuating member 148 upon rotation of cam 136, as described hereinafter. A slot 149 is formed along the underside of base 80 for receiving the arm 146 in engagement with drive pin 144.

Referring back to FIGS. 11 and 12, drive mechanism 14 also includes a stripper actuating member 148 which is slidable linearly along the printer deck toward and away from rollers 82 and 84. Member 148 has a pair of recesses 150 along its opposite sides for receiving the pins 60 of stripper 48. Additionally, arm 146 is pivoted to member 148 and drives member 148 between the retracted and extended positions, illustrated in FIGS. 11 and 12, respectively. It will be appreciated that when pins 60 engage recesses 150, movement of the stripper actuating member 148 causes following movement of stripper 48 toward and away from the rollers.

In use, the cartridge 10 is supplied with the stripper held in its retracted position by springs 74. It will be appreciated that, in such condition, the endless ribbon R is gathered and compressed in a random manner in storage compartment 28 with a portion of the ribbon extending between arms 24 and 26. To properly position the ribbon between the arms in the printer, any slack in that ribbon is taken up by twisting the rotary device 34 in either direction. Additionally, any slack in the ribbon between stripper 48 and rotary device 34 is simultaneously taken up, thereby straightening the ribbon between stripper 48 and the first roller 50.

With the drive mechanism 14 disposed in its open position as illustrated in FIG. 3, cartridge 10 is then placed on the printer deck 12 and receives drive mechanism 14 through its bottom opening 32. When the cartridge 10 is seated on deck 12, crank handle 134 projects through top opening 30 of the top wall 30 of the cartridge. Additionally, the pins 60 of stripper 48 engage in the recesses 150 of stripper actuating member 148. It will be appreciated that, in this open position of the drive mechanism, cam 136 has previously been rotated such that cam detenting surface 142 bears against pin 104 of base 80, preventing spring 112 from pivoting lever 86 from its first retracted position (FIG. 3) into its second engaged position (FIG. 4) with idler roller 84 engaging the ribbon against drive roller 82. By lowering cartridge 10 onto the printer deck with drive mechanism 14 received within the cartridge, the tightened ribbon between stripper 48 and roller 50 is automatically located between the spaced rollers 82 and 84.

To engage the ribbon, crank handle 134 is rotated, for example, in a counterclockwise direction as illustrated in FIG. 3, into the position illustrated in FIG. 4. By rotating the crank handle, detent surface 142 is removed from engagement with pin 104 and cam surface 140 bears along pin 104 from its high surface adjacent detent surface 142 to a low surface, enabling spring 112 to rotate lever 86 in a clockwise direction as seen in comparing FIGS. 3 and 4, moving idler roller 84 toward drive gear 82.

Figure 11:
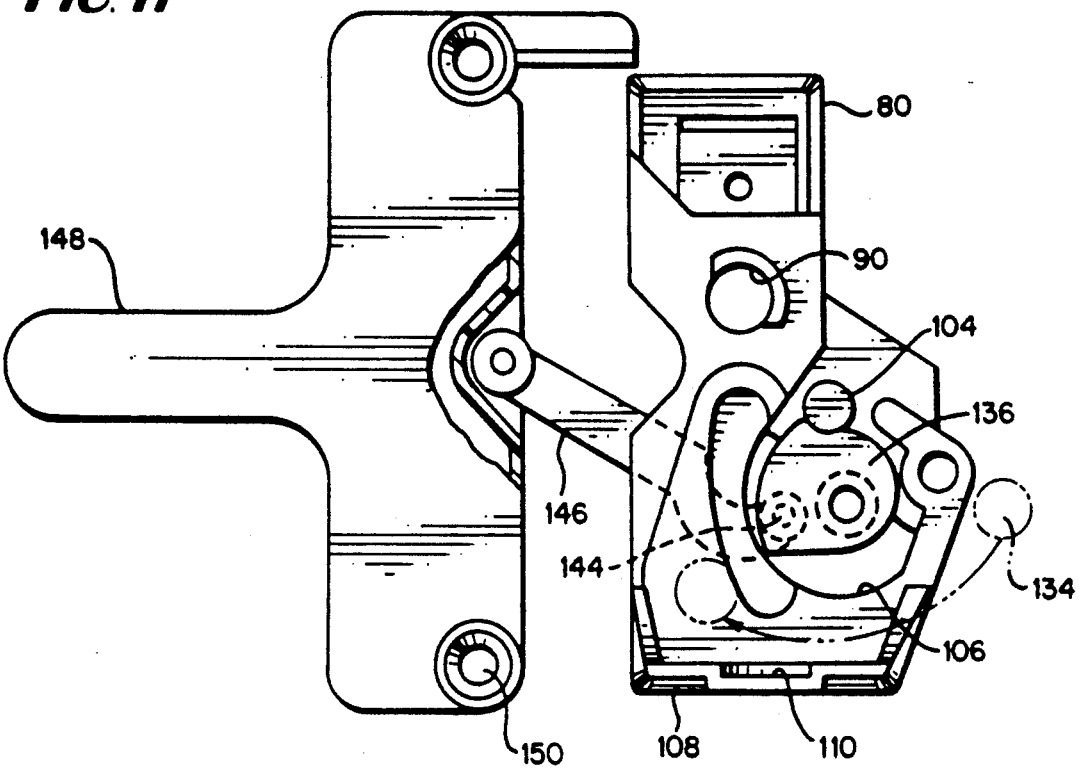
FIG. 11 is a plan view of the drive system portion for displacing the stripper actuating member and illustrated with the drive system lever removed.
Figure 12:
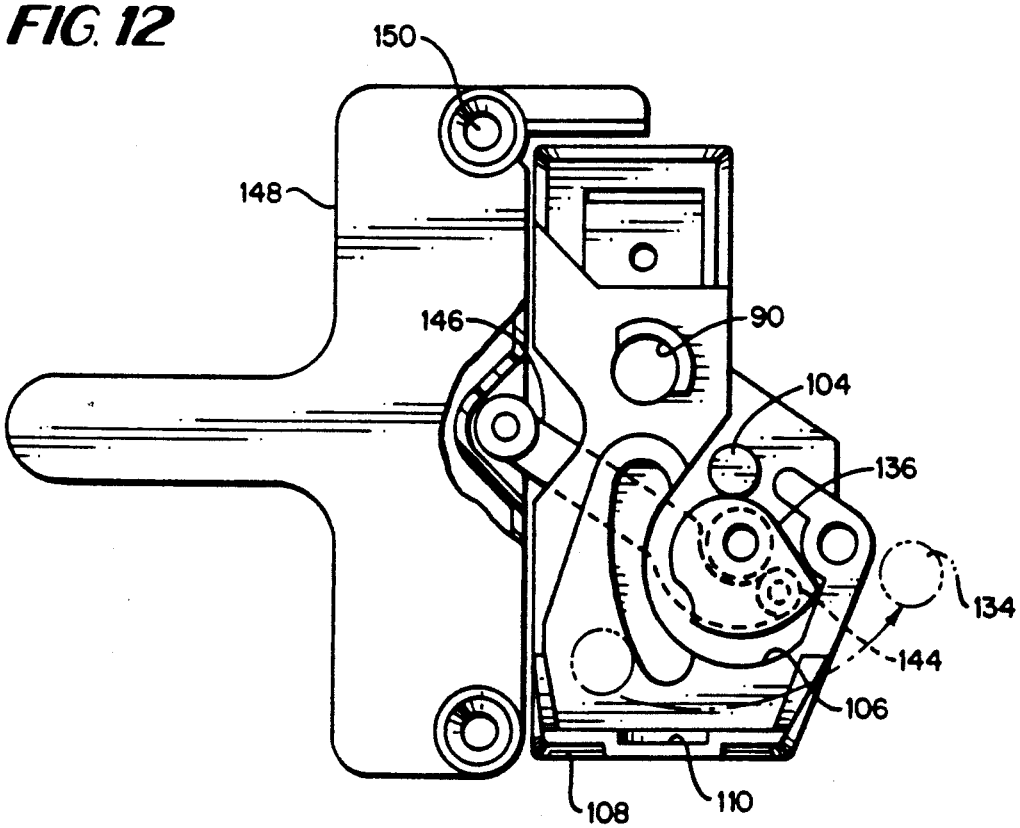
FIG. 12 is a view similar to FIG. 11 illustrating the drive system portion in a position where the rollers engage the print ribbon.

As cam 136 is rotated, the combined rotary action of the cam relative to the lever 86 and movement of lever 86 about pivot 88 displaces drive arm 146 from the position illustrated in FIG. 11 to that illustrated in FIG. 12. That is, movement of the arm 146 by rotating cam 136 pulls the stripper actuating member 148 linearly along the bottom wall of cartridge 10 toward rollers 82 and 84. Simultaneously, because of the pinned connection between member 148 and stripper 48, stripper 48 is likewise moved within the cartridge initially against the bias of springs 74 and toward rollers 82 and 84. As the crank arm 134 is rotated and the lever is rotated to engage the ribbon between the rollers, springs 74 revert biasing stripper 48 for retention in its advanced position. It will also be appreciated that the stripper elements 64 in this advanced position of stripper 48 moved into the grooves 122 and 124 of the rollers and also straddle the rollers at their upper and lower ends. The stripper elements are thus in position to strip the ribbon passing through the slot 66 from the rollers as the drive gear rotates to advance the ribbon past the rollers and stripper into the storage compartment 28. Additionally, the stripper elements, by engaging in grooves 122 and 124, prevent the cartridge from being lifted off the drive mechanism and printer deck. Further, rotation of the crank handle 134 into the position illustrated in FIG. 4 displaces it into overlying relation to the top wall 18 of cartridge 10, also preventing removal of the cartridge from the printer deck.

After use and when it is desired to remove the ribbon cartridge from the printer deck and replace it with a fresh cartridge, the ribbon is disengaged by the rollers and stripper 48 is displaced rearwardly to displace the stripper elements from their positions straddling rollers 82 and 84 and within grooves 122 and 124 of the rollers. To accomplish this, the crank arm 134 is rotated, for example, clockwise from the position illustrated in FIG. 4 to the position illustrated in FIG. 3. This aligns the crank handle in registration with the cartridge wall openings 30 and 32, and simultaneously withdraws the stripper elements from the rollers, enabling the cartridge to be subsequently lifted off the printer deck. By rotating the crank handle 134 in the clockwise direction, the cam as illustrated in FIG. 12 bears against pin 104 to pivot lever 86 away from the drive roller against the bias of spring 112 to open a gap between the idler roller and drive roller. Simultaneously, drive arm 146 is displaced (pushed) by the cam and drives (pushes) stripper actuating member 148 away from the rollers. Stripper 48, through its pinned engagement with member 148, is moved into its retracted position illustrated in FIG. 3. Springs 74 also revert to maintain the stripper retracted position. The ribbon cartridge 10 may then be removed by lifting it from the printer deck and drive mechanism and may be replaced by a fresh cartridge loaded into the printer in a similar manner as previously described.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A ribbon cartridge for a printer having a ribbon drive mechanism including a pair of rollers for engaging a print ribbon therebetween, comprising:

an elongated cartridge housing having top, bottom, and side walls and a pair of arms projecting to one side of said housing adjacent opposite ends thereof, respectively;

said walls in part defining a storage chamber for receiving and storing the print ribbon, said arms defining entrance and exit paths, respectively, for receiving the ribbon for delivery to the storage chamber and supplying the ribbon from the storage chamber for spanning between said arms, said bottom wall having an opening therein for receiving the pair of rollers substantially within the confines of the cartridge housing when the cartridge is loaded into the printer;

a stripper having stripper elements and carried by said cartridge housing for movement between a first retracted position and a second extended position with the stripper elements disposed adjacent the pair of rollers for stripping the ribbon from the rollers;

said bottom wall including a pair of openings having an extent in the direction of the housing substantially at least equal to the range of movement of said stripper in said cartridge between said first and second positions;

said stripper including a pair of pins projecting through said openings below said bottom wall for engagement of at least one pin thereof by a drive carried by the printer for displacing said stripper from one of said first and second positions into the other of said first and second positions.

2. A ribbon cartridge according to claim 1 wherein said stripper includes a wall facing said storage chamber for retaining the ribbon within said chamber.

3. A ribbon cartridge according to claim 2 wherein said stripper elements comprise a plurality of fingers projecting in a direction away from said storage chamber, at least a pair of fingers of said plurality thereof being transversely spaced one from the other to define a slot therebetween for receiving the ribbon.

4. A ribbon cartridge according to claim 1 including means carried by said cartridge housing and engageable with said stripper for resiliently biasing said stripper for movement toward one of said first and second positions.

5. A ribbon cartridge according to claim 1 in combination with said print ribbon, a rotatable ribbon spooler carried by said housing and responsive to rotation thereof in one direction for taking up slack in said ribbon spanning between the ends of said arms.

6. A ribbon cartridge according to claim 1 in combination with said print ribbon, a portion of said ribbon spanning across said bottom opening, a rotatable ribbon spooler carried by said housing responsive to rotation thereof in one direction for taking up slack in said ribbon portion spanning across said bottom opening.

7. A ribbon cartridge according to claim 1 in combination with said print ribbon, a rotatable ribbon spooler carried by said housing, said spooler comprising a pair of pins spaced from and rotatable about the axis of rotation of said spooler, said ribbon being disposed between said pins with portions thereof being taken up by said pins, respectively, upon rotation of said device in one direction to simultaneously take up slack in ribbon portions extending from said spooler in opposite directions.

8. In a printer having a printer deck for mounting a printer cartridge containing print ribbon, a drive mechanism for the print ribbon, comprising:

drive and idler rollers carried by said printer and projecting from said printer deck;

a lever carrying said idler roller and mounted for movement on said printer deck for moving said idler roller laterally toward and away from said drive roller;

means for moving said lever between a first position for engaging the print ribbon between said rollers and a second position spacing said idler roller from said drive roller;

means for biasing said lever for movement into one of said first and second positions;

means for detenting said lever in the other of said first and second positions;

control means for displacing said lever from said detented position enabling said lever for movement toward said one position;

a ribbon stripper actuating member for engagement with a ribbon stripper in the cartridge and carried by said printer deck for movement toward and away from said rollers; and an arm interconnecting said member and said moving means such that said member is movable toward and away from said rollers in response to movement of said idler gear toward and away from said drive roller, respectively.

9. A printer according to claim 8 wherein said detenting means includes a cam and a pin engageable by said cam for detenting said lever in said other of said first and second positions, said arm being coupled to said cam.

10. A printer according to claim 8 wherein said lever is mounted for pivotal movement about an axis, said detenting means including a cam pivotally carried by said lever for pivotal movement about an axis spaced from the pivotal axis of said lever.

11. A printer according to claim 10 wherein said moving means includes a handle carried by said lever for rotating said cam.

12. A printer according to claim 8 wherein said lever is mounted for pivotal movement about an axis, said detenting means including a cam pivotally carried by said lever for pivotal movement about an axis spaced from the pivotal axis of said lever and a pin engageable by said cam for detenting said lever in said other of said first and second positions, said arm being coupled to said cam, said moving means including a handle carried by said lever for rotating said cam.

13. A printer according to claim 8 in combination with said printer cartridge and said ribbon carried by said cartridge, said cartridge including an elongated cartridge housing having top, bottom and side walls and a pair of arms projecting to one side of said housing adjacent opposite ends thereof, respectively;

said walls in part defining a storage chamber for receiving and storing said print ribbon, said arms defining entrance and exit paths, respectively, for receiving said ribbon for delivery to the storage chamber and supplying said ribbon from said storage chamber for spanning between said arms, said bottom wall having an opening therein for receiving said pair of rollers substantially within the confines of said cartridge housing when said cartridge is disposed overlying said printer deck;

a stripper having stripping elements and carried by said cartridge housing for movement between a first retracted position and a second extended position, said stripper elements, in said second extended position of said stripper, being disposed adjacent said rollers, when said rollers engage said print ribbon therebetween, for stripping the ribbon from said rollers; and means engageable between said member and said stripper such that said stripper moves away from said rollers into its first retracted position in response to movement of said member away from said rollers and moves into said second extended position in response to movement of said member toward said rollers.

14. Apparatus according to claim 13 wherein said bottom wall includes at least one slot having an extent in the direction of said housing substantially at least equal to the range of movement of said stripper in said cartridge between said first and second positions; and a coupling element extending through said slot and coupling said stripper and said member one to the other whereby movement of said stripper follows movement of said member.

15. A ribbon cartridge according to claim 14 wherein said stripper includes a wall facing said storage chamber for retaining the ribbon within said chamber.

16. A ribbon cartridge according to claim 13 wherein said stripper elements comprise a plurality of fingers projecting in a direction away from said storage chamber, at least a pair of fingers of said plurality thereof being transversely spaced one from the other to define a slot therebetween for receiving said ribbon.

17. A ribbon cartridge according to claim 13 wherein at least one of said drive roller and said idler roller has a circumferential recess formed through its surface, at least one of said stripper elements engaging in said recess when said stripper lies in said second extended position to retain said cartridge on said printer deck against movement thereof in a direction away from said deck.

18. Apparatus according to claim 13 wherein said control means includes an element movable to overlie said top wall of said cartridge when said lever is pivoted toward said first position to prevent removal of said cartridge from said printer deck.

19. Apparatus according to claim 13 wherein said lever is mounted for pivotal movement about an axis, said detenting means including a cam pivotally carried by said lever for pivotal movement about an axis spaced from the pivotal axis of said lever, said housing means biasing said lever for pivotal movement into said first position for engaging the print ribbon between said rollers, said detenting means detenting said lever in said second position against the bias of said biasing means.

20. A parts kit for assembly into a ribbon cartridge for a printer having a ribbon drive mechanism, including a pair of rollers for engaging a ribbon therebetween, comprising:

a top wall part having portions for defining in part a storage chamber for a ribbon;

a bottom wall part having portions for defining in part the storage chamber for the ribbon, said bottom wall part having an opening for receiving the ribbon drive mechanism upon loading the assembled cartridge into the printer;

one of said top and bottom wall parts including portions defining at least in part ribbon entrance and ribbon exit arms;

said top and bottom wall parts being adapted for assembly one with the other to form the ribbon cartridge with said portions of the top and bottom wall parts defining a storage chamber for the ribbon;

a stripper for assembly within the cartridge, said stripper including a pair of laterally spaced stripper elements for stripping ribbon from the rollers and defining a slot therebetween for receiving ribbon upon assembly of the kit to form the cartridge and loading thereof into the printer;

said stripper having guides for mounting the stripper within the cartridge upon its assembly for movement in a direction toward and away from said bottom opening, said stripper having at least one pin projecting therefrom and through said bottom wall part for engagement by the drive mechanism upon loading the assembled cartridge into the printer.

21. A kit according to claim 20 wherein said stripper includes a pair of pins projecting therefrom through the bottom wall part for engagement by the drive mechanism of the printer.

22. A kit according to claim 20 including a slot formed in said bottom wall part for receiving said pin for enabling movement of said stripper toward and away from said bottom opening.

23. A kit according to claim 20 wherein said bottom wall part includes a pair of openings adjacent opposite sides thereof and said stripper includes a pair of pins adjacent opposite sides thereof for passage through said openings, respectively.

24. A kit according to claim 23 wherein said stripper includes a wall portion spaced from said stripper elements for at least in part laterally spanning the cartridge when assembled to load and confine the ribbon in the storage chamber.

25. A kit according to claim 24 wherein said stripper includes at least one tab for projecting over the slot defined by said stripper elements for maintaining the ribbon in said slot upon assembly of the cartridge and loading it into the printer.

26. A stripper for location in a ribbon cartridge for stripping ribbon from drive rollers and guiding the ribbon into a storage chamber of the cartridge, comprising:

a stripper body for generally horizontal slidable movement within the cartridge toward and away from the drive rollers and having a laterally extending wall;

a pair of laterally spaced stripper elements projecting forwardly from said stripper body and defining a forwardly extending slot for receiving ribbon therebetween;

upstanding wall portions projecting from said laterally extending wall and located rearwardly of said stripper elements for engaging ribbon in the storage chamber of the cartridge on the side of the stripper body opposite said stripper elements, said wall portions having an opening therebetween for receiving ribbon from said slot for entry into the storage chamber; and a pair of pins projecting downwardly from said laterally extending wall adjacent its opposite ends and for termination below said stripper elements.

27. A stripper according to claim 26 including a horizontal wall portion spaced above said laterally extending wall and having a tab projecting forwardly in registration with said slot.

* * * * *